US006070945A

United States Patent [19]

Ritchey et al.

[11] Patent Number: 6,070,945

[45] Date of Patent: Jun. 6, 2000

[54] CUTTING TOOL RETAINER

[75] Inventors: Cary D. Ritchey, Curryville; Wayne H. Beach, Roaring Spring; Stephen P. Stiffler, New Enterprise, all of Pa.

[73] Assignee: Kennametal Inc., Latrobe, Pa.

[21] Appl. No.: 09/115,985

[22] Filed: Jul. 15, 1998

[51] Int. Cl.[7] ..... E21C 35/19

[52] U.S. Cl. ..... 299/107; 299/109; 403/154; 24/673

[58] Field of Search ..... 299/106, 107, 299/109; 24/673; 403/154, 155; 37/455–459; D8/394, 395

[56] References Cited

U.S. PATENT DOCUMENTS

| | | | |
|---|---|---|---|
| Re. 18,144 | 11/1931 | Heiermann . | |
| 3,690,728 | 9/1972 | Krekeler | 299/107 X |
| 3,952,433 | 4/1976 | Heinold et al. | 299/109 X |
| 3,957,307 | 5/1976 | Varda | 299/107 |
| 4,404,760 | 9/1983 | Hahn et al. | 37/142 |
| 4,505,058 | 3/1985 | Peterson . | |
| 4,650,254 | 3/1987 | Wechner . | |
| 4,684,176 | 8/1987 | Den Besten et al. | 299/107 |
| 4,733,987 | 3/1988 | Tomlinson et al. . | |
| 4,763,956 | 8/1988 | Emmerich | 299/107 |
| 4,883,129 | 11/1989 | Lonn et al. . | |
| 5,011,229 | 4/1991 | O'Neill et al. . | |
| 5,529,384 | 6/1996 | Ojanen et al. | 299/107 |
| 5,690,393 | 11/1997 | Massa et al. | 299/107 |
| 5,720,528 | 2/1998 | Ritchey | 299/107 |

FOREIGN PATENT DOCUMENTS

| | | |
|---|---|---|
| 2716177 | 10/1977 | Germany . |
| 172654 | 9/1995 | Poland . |
| 2079350 | 1/1982 | United Kingdom . |

OTHER PUBLICATIONS

Kennametal Inc. Brochure entitled "Construction Tools," 1997, p. 15.

Kennametal Inc. Brochure entitled "Kennametal Mining Products," 1996, p. 11.

Rotor Clip Company, Inc.'s Catalog and Engineering Manual entitled "Rotor Clip Retaining Rings," 1985–91.

PCT Search Report dated Oct. 15, 1999.

*Primary Examiner*—Eileen Dunn Lillis
*Assistant Examiner*—Sunil Singh
*Attorney, Agent, or Firm*—John J. Prizzi

[57] ABSTRACT

A retainer clip adapted to engage a recess in a shank of a cutting tool for securing the cutting tool to a support block. The retainer clip includes a clip body having first and second end portions and at least three protruding portions disposed between the end portions. The protruding portions are adapted to extend beyond the shank when the retainer clip is engaging the recess.

23 Claims, 3 Drawing Sheets

Fig. 2
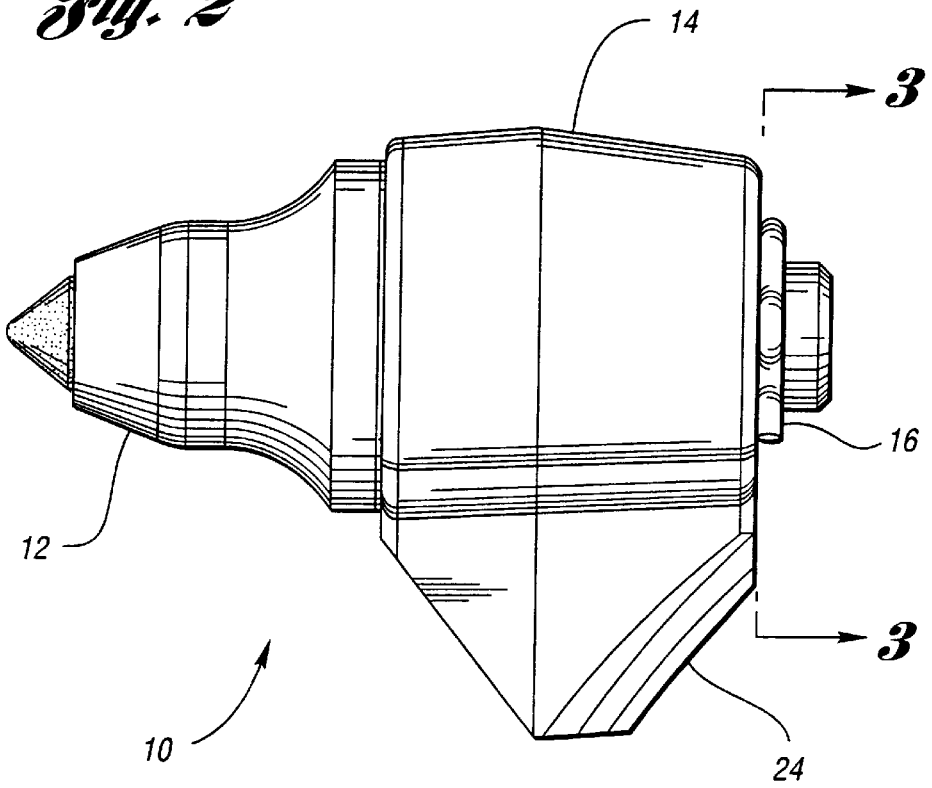
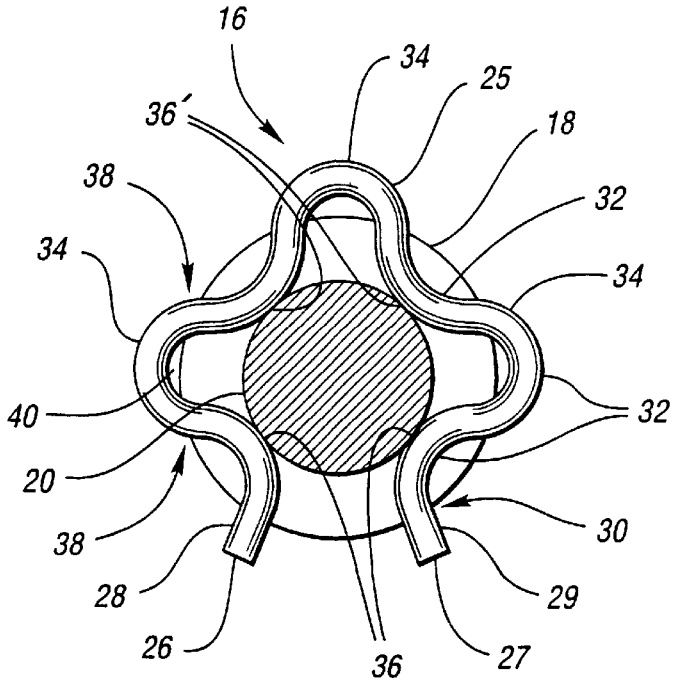
Fig. 3

CUTTING TOOL RETAINER

TECHNICAL FIELD

The invention relates to a retainer clip for retaining a cutting tool in a support block.

BACKGROUND ART

Cutting tool assemblies for such applications as mining or road milling typically comprise a cutting tool, sometimes referred to as a cutting pick, rotatably mounted within a support block. The support block in turn is mounted onto a drum or other body, typically by welding, which in turn is driven by a suitable drive means. When a number of such support blocks carrying cutting tools are mounted onto a drum, and the drum is driven, the cutting tools will engage and break up the material sought to be mined or removed. The general operation of such a mining or construction machine is well known in the art.

Various retaining devices have been proposed or used to mount a cutting tool, rotatably or otherwise, within a support block. For example, U.S. Pat. No. 4,505,058 to Peterson shows a retainer having two legs. This retainer is intended to be used with a support block having a recess with specially configured sidewalls which cooperate with the bends in the retainer legs to hold the retainer in place. More specifically, the sidewalls of the recess include projections to limit movement of the retainer with respect to the support block. This type of retainer is relatively difficult to move in order to disengage the retainer from the cutting tool in that a screwdriver or other similar object must be inserted into the recess and under the top of the retainer in order to pry and move the retainer. Like other similar retainers relying on prongs, the two legs of this retainer provide only four shear zones or areas where the retainer overlaps both the cutting tool and the support block. Because these shear zones prevent disengagement of the cutting tool from the support block, the number of such shear zones relates to the strength and durability of the retainer.

U.S. Pat. No. 4,883,129 to Lonn et al. shows another retaining device or ring which overlaps a cutting tool shank and a support block along substantially the entire length of the retaining ring. Consequently, the retaining ring provides a single, continuous shear zone along its entire length. However, this type of retaining ring is difficult to install and remove. More specifically, this retaining ring does not provide any slots or openings which may be grasped or which may receive a device for prying the retaining ring from the cutting tool shank. Furthermore, because the portion of the retaining ring that overlaps the support block is relatively narrow, this type of retaining ring does not sufficiently secure the cutting tool within the support block over an extended period of time.

SUMMARY OF THE INVENTION

It is an object of the invention to provide an improved retainer clip adapted to engage a recess in a cutting tool for securing the cutting tool to a support block.

In one embodiment of the invention, the retainer clip comprises a clip body having first and second end portions, and at least three protruding portions disposed between the end portions. The protruding portions are adapted to extend beyond the shank when the retainer clip is engaging the recess. An advantage of this embodiment is that the resulting number of shear zones yields very good strength and durability characteristics.

In another embodiment of the invention, the retainer clip comprises a clip body having first and second end portions, and at least one protruding portion disposed between the end portions. The at least one protruding portion has a straight section which is adapted to be remote from the shank when the retainer clip is engaging the recess. An advantage of this embodiment is that the straight section increases the resiliency and flexibility of the retainer clip, making it easier to install or remove. Another advantage is that the straight section is easier to grasp or be engaged by a suitable tool.

In each of these embodiments, the clip body may have a circular or rectangular cross-section.

In yet another embodiment of the invention, the retainer clip comprises a clip body having first and second end portions, and at least one protruding portion disposed between the end portions. Furthermore, the end portions and the protruding portions have rectangular cross-sections. An advantage of this embodiment is that the dimensions of the rectangular cross-section can be proportioned so as to maximize shear strength, flexibility, and resiliency.

In each of these embodiments, one or both of the end portions may be splayed outwardly.

In each of these embodiments, one or more of the end portions and protruding portions may define a shear zone. Each of the shear zones overlaps both the shank and the support block and prevents disengagement of the cutting tool from the support block.

In each of these embodiments, a protruding portion may define a gap which extends radially beyond the shank when the retainer clip is installed on the shank. The gap provides a location for inserting a suitable tool to remove the retainer clip from the recess of the cutting tool.

Each of the embodiments may be varied or have additional features as set forth in the specification and claims.

While an exemplary retainer clip is illustrated and disclosed, such disclosure should not be construed to limit the claims. It is anticipated that various modifications and alternative designs may be made without departing from the scope of the invention.

BRIEF DESCRIPTION OF THE DRAWINGS

FIG. 2 is a side view of the cutting tool assembly;

FIG. 3 is a cross-sectional view taken along line 3—3 of FIG. 2 in the direction of the arrows, and showing the retainer clip and a shank of the cutting tool;

BEST MODES FOR CARRYING OUT THE INVENTION

Figure 1:
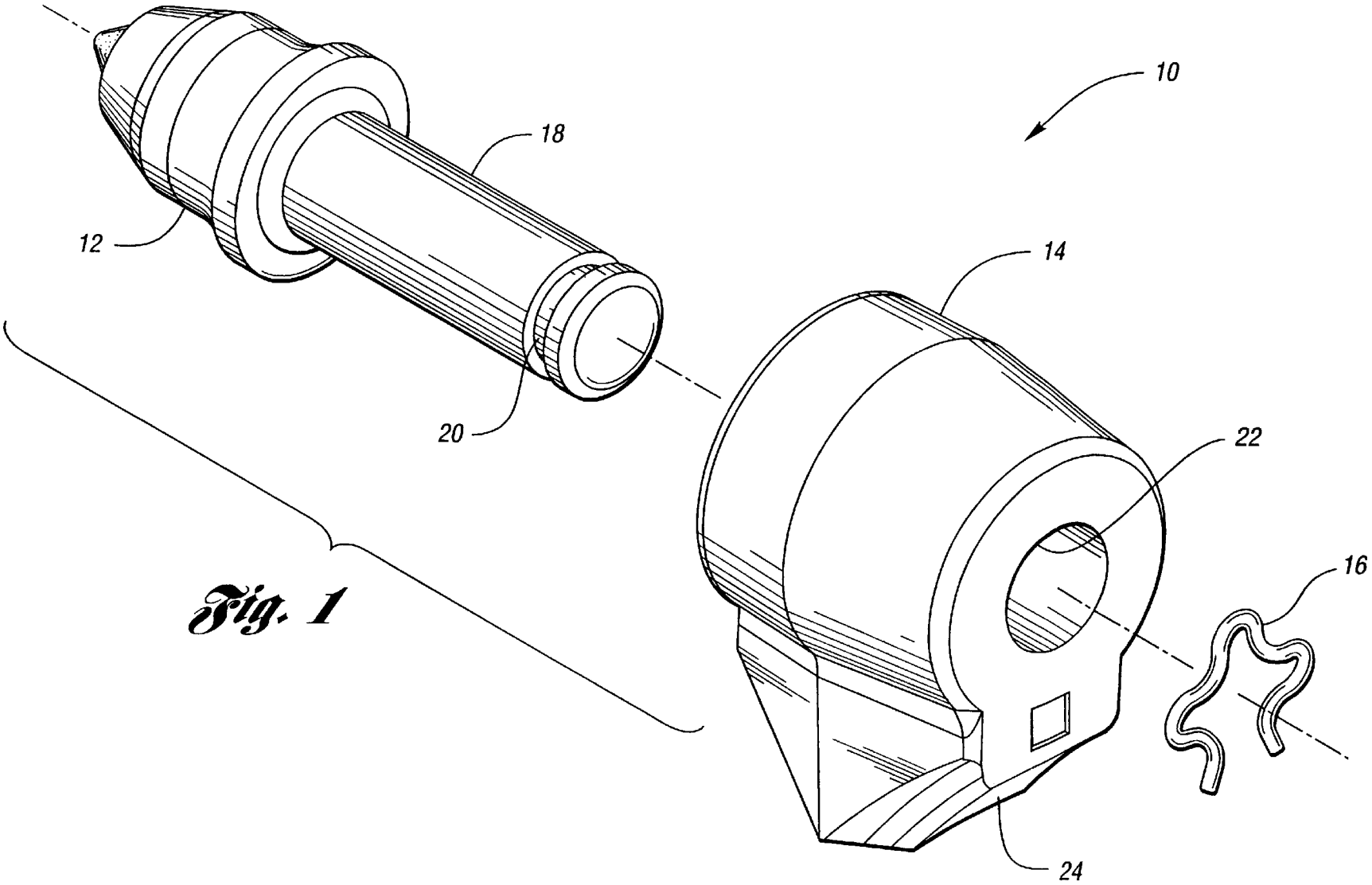
FIG. 1 is an exploded perspective view of a cutting tool assembly including a cutting tool, a support block and one embodiment of the retainer clip of this invention.

Referring to the drawings, FIGS. 1 and 2 show a cutting tool assembly 10 including a cutting tool 12, a support block 14 and a retainer clip 16 according to the invention. The cutting tool 12 has a preferably cylindrical shank 18 with an annular groove or recess 20 for receiving the retainer clip 16. The support block 14 has a preferably cylindrical bore 22 for receiving the shank 18, and a base 24 which can be welded or otherwise attached to a drum (not shown).

As shown in FIG. 3, the retainer clip 16 has a clip body 25. The clip body 25 has first and second ends 26 and 27 having end portions 28 and 29, respectively, and the end portions 28 and 29 are preferably outwardly splayed to facilitate installation of the retainer clip 16 onto the cutting tool shank 18. At least one of the end portions 28 and 29 preferably extends over both the shank 18 and the support block 14, thereby defining at least one discrete shear zone 30. The term "shear zone" as used in this application means a portion of the clip body 25 that overlaps both the shank 18 and the support block 14.

The clip body 25 of this invention has a plurality of curved sections 32 between and formed integral with the end portions 28 and 29. The curved sections 32 in this embodiment define protruding portions 34 which protrude beyond the diameter of the cylindrical shank 18 so as to engage the support block 14 and prevent removal of the shank 18 from the bore 22. While any suitable configuration may be used, the protruding portions 34 in this embodiment are generally U-shaped. In this embodiment, the curved sections 32 also define engaging portions 36 and 36' which reside within and engage the recess 20. While any suitable configuration may be used, in this embodiment the engaging portions 36 and 36' are generally U-shaped.

Each of the protruding portions 34 defines two discrete shear zones 38 which are engageable with the shank 18 and the support block 14 for securing the cutting tool 12 to the support block 14. Each of the U-shaped protruding portions 34 also cooperates with the shank 18 to define a gap 40 which extends radially beyond the shank 18 when the retainer clip 16 is properly installed on the shank 18. Alternatively, the protruding portions 34 may have any suitable shape such that both ends of each protruding portion overlap the shank 18 when the retainer clip 16 is properly installed on the shank.

In order to use the retainer clip 16 of this invention, the cylindrical shank 18 of the cutting tool 12 is inserted into the bore 22 of the support block 14 such that the annular groove or recess 20 is exposed. The splayed first and second end portions 28 and 29 of the retainer clip 16 are then placed within the annular groove or recess 20 of the cutting tool 12. As the retainer clip 16 is pressed onto the annular groove or recess 20, the splayed first and second end portions 28 and 29 will bend outwardly from each other until the retainer clip 16 snaps into place. When the retainer clip 16 is properly installed on the shank 18, the engaging portions 36' bear upon the recess 20 to prevent further transverse movement of the retainer clip relative to the shank.

To remove the retainer clip 16, one of the U-shaped protruding portions 34 may be grasped by a suitable tool, such as pliers, to pull the retainer clip 16 away from the annular groove or recess 20 of the cutting tool 12. Alternatively, a suitable tool such as a screwdriver may be inserted into the gap 40 such that the retainer clip 16 may be pried from the annular groove or recess 20 of the cutting tool 12.

The clip body 25 of the retainer clip 16 is preferably formed as a single piece from resilient high carbon spring steel wire having a substantially uniform circular cross-section. A suitable steel wire is 0.125 inch diameter No. 1060 to 1070 carbon steel having a hardness value preferably in the range of 42 to 48 Rc. Such material is readily available and can be formed into the desired shape using any suitable method. Alternatively, the clip body 25 of the retainer clip 16 may be formed from any suitable material having any suitable cross-sectional configuration. For example, the clip body 25 of the retainer clip 16 may be formed from material having a rectangular cross-section.

Because the retainer clip 16 of the embodiment shown has at least seven shear zones which secure the cutting tool 12 to the support block 14, the retainer clip 16 has great strength and durability. The outwardly splayed end portions 28 and 29 and the gaps 40 also enable the retainer clip 16 to be installed on and removed from the cutting tool 12 quickly and easily.

Figure 4:
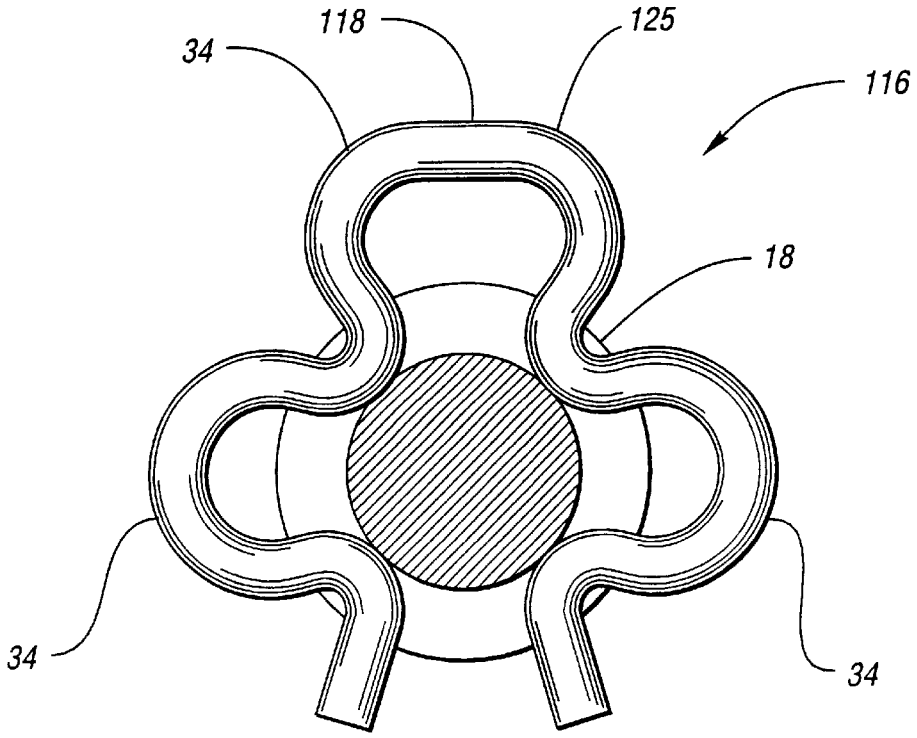
FIG. 4 is a cross-sectional view similar to FIG. 3 showing an alternative embodiment of the retainer clip of this invention mounted on the shank of a cutting tool.

FIG. 4 shows an alternative embodiment of the retainer clip 116, having a clip body 125, which has all of the features of the retainer clip 16. In addition, at least one of the generally U-shaped protruding portions 34 of the retainer clip 116 has a generally straight section 118 which is adapted to be remote from the shank 18 when the retainer clip is installed on the shank 18. The straight section 118 increases the flexibility and resiliency of the retainer clip 116, thereby making the retainer clip 116 easier to install or remove and improving the ability of the retainer clip 116 to spring back to its original shape after being installed on or removed from the cutting tool 12. The straight section 118 also provides additional material which may be grasped or otherwise engaged by a suitable tool.

As with the retainer clip 16, the clip body 125 of the retainer clip 116 may be made of any suitable material having any suitable cross-sectional configuration. For example, the clip body 125 of the retainer clip 116 shown in FIG. 4 may be made of a high carbon steel wire having a circular cross-section.

Figure 5:
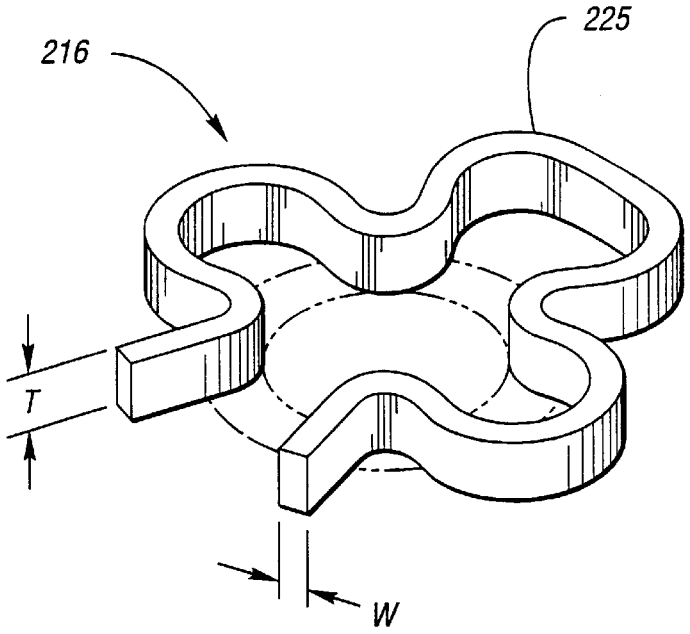
FIG. 5 is a perspective view of yet another alternative embodiment of the retainer clip of this invention.

FIG. 5 shows yet another embodiment of this invention. More specifically, the retainer clip 216 shown in FIG. 5 having a clip body 225 is similar to the retainer clip 116 shown in FIG. 4 except that the clip body 225 of the retainer clip 216 is made of high carbon steel having a rectangular cross-section. By using material having a rectangular cross-section, the thickness T of the retainer clip 116 can be made larger than the width W. Consequently, the shear strength of the retainer clip 116 can be maximized, while also providing sufficient flexibility and resiliency to the retainer clip.

The invention has been described in an illustrative manner, and it is to be understood that the terminology which has been used is intended to be in the nature of words of description rather than of limitation. Obviously, many modifications and variations of the invention are possible in light of the above teachings. It is, therefore, to be understood that within the scope of the appended claims, the invention may be practiced otherwise than as specifically described.

What is claimed is:

1. A retainer clip for securing a cutting tool to a support block, the cutting tool having a shank with a recess, the retainer clip being adapted to engage the recess, the retainer clip comprising:

a clip body having first and second end portions, and at least three protruding portions disposed between the end portions, the at least three protruding portions being adapted to extend beyond the shank when the retainer clip is engaging the recess such that each protruding portion defines a gap that extends radially beyond the shank, wherein each gap is surrounded by a respective protruding portion and the shank.

2. The retainer clip of claim 1 wherein at least one of the first and second end portions is outwardly splayed.

3. The retainer clip of claim 1 wherein at least one of the first and second end portions defines a shear zone.

4. The retainer clip of claim 1 wherein the end portions and the protruding portions cooperate to define at least seven shear zones for securing the cutting tool to the support block.

5. The retainer clip of claim 1 wherein the clip body has at least four engaging portions for engaging the recess and each protruding portion is located between two engaging portions.

6. The retainer clip of claim 1 wherein at least one of the protruding portions has a straight section which is adapted to be remote from the shank when the retainer clip is engaging the recess.

7. A retainer clip for securing a cutting tool to a support block, the cutting tool having a shank with a recess, the retainer clip being adapted to engage the recess, the retainer clip comprising:

a clip body having first and second end portions, and at least three protruding portions disposed between the end portions, the at least three protruding portions being adapted to extend beyond the shank when the retainer clip is engaging the recess such that each protruding portion defines a gap that extends radially beyond the shank, wherein each gap is surrounded by a respective protruding portion and the shank, and wherein at least one of the at least three protruding portions has a straight section which is adapted to be remote from the shank when the retainer clip is engaging the recess.

8. The retainer clip of claim 7 wherein at least one of the first and second end portions is outwardly splayed.

9. The retainer clip of claim 7 wherein at least one of the first and second end portions defines a shear zone.

10. The retainer clip of claim 7 wherein each of the at least three protruding portions defines two shear zones.

11. The retainer clip of claim 7 wherein the end portions and the at least three protruding portions cooperate to define at least seven shear zones.

12. The retainer clip of claim 7 wherein the clip body has at least four engaging portions for engaging the recess, and each of the at least three protruding portions is located between two engaging portions.

13. A retainer clip for securing a cutting tool to a support block, the cutting tool having a shank with a recess, the retainer clip being adapted to engage the recess, the retainer clip comprising:

a clip body having a rectangular cross-section, first and second end portions, and at least three protruding portions disposed between the end portions, the at least three protruding portions being adapted to extend beyond the shank when the retainer clip is engaging the recess such that each protruding portion defines a gap that extends radially beyond the shank, wherein each gap is surrounded by a respective protruding portion and the shank, and wherein at least one of the at least three protruding portions has a straight section which is adapted to be remote from the shank when the retainer clip is engaging the recess such that an axis extending longitudinally through the straight section does not intersect the shank.

14. The retainer clip of claim 13 wherein at least one of the first and second end portions is outwardly splayed.

15. The retainer clip of claim 13 wherein at least one of the first and second end portions defines a shear zone.

16. The retainer clip of claim 13 wherein each protruding portion defines two shear zones.

17. The retainer clip of claim 13 wherein the end portions and the protruding portions cooperate to define at least seven shear zones.

18. The retainer clip of claim 13 wherein the clip body has at least four engaging portions for engaging the recess and each protruding portion is located between two engaging portions.

19. The retainer clip of claim 13 wherein the rectangular cross-section has a thickness and a width and the thickness is larger than the width.

20. A cutting tool assembly comprising:

a cutting tool having a shank, the shank having a recess;

a support block having a bore for receiving the shank; and a retainer clip removably disposed about the recess for securing the cutting tool to the support block, the retainer clip including a clip body having first and second end portions, and at least three protruding portions disposed between the end portions, the at least three protruding portions being adapted to extend beyond the shank when the retainer clip is disposed about the recess such that each protruding portion defines a gap that extends radially beyond the shank, wherein each gap is surrounded by a respective protruding portion and the shank.

21. The cutting tool assembly of claim 20 wherein the end portions and the protruding portions of the clip body cooperate to define at least seven shear zones for securing the cutting tool to the support block.

22. The cutting tool assembly of claim 20 wherein the clip body has at least four engaging portions for engaging the recess when the retainer clip is disposed about the recess, and each protruding portion is located between two engaging portions.

23. The cutting tool assembly of claim 22 wherein at least one of the protruding portions has a straight section which is adapted to be remote from the shank when the retainer clip is disposed about the recess.

* * * * *